US005711094A

United States Patent [19]

Grossman

[11] Patent Number: 5,711,094

[45] Date of Patent: Jan. 27, 1998

[54] PAIR OF SHOES FOR USE BY GOLFERS AND A METHOD OF SWINGING A GOLF CLUB USING THE SAME

[76] Inventor: Gerald Grossman, 6100 Westchester Park Dr. No. 1019, College Park, Md. 20740

[21] Appl. No.: 812,162

[22] Filed: Mar. 6, 1997

Related U.S. Application Data

[63] Continuation of Ser. No. 561,707, Nov. 22, 1995, abandoned.

[51] Int. Cl.[6] ..... A43B 5/00

[52] U.S. Cl. ..... 36/127; 36/114; 36/134; 36/59 C

[58] Field of Search ..... 36/127, 59 C, 36/114, 134, 132, 59 R, 67 R, 67 A

[56] References Cited

U.S. PATENT DOCUMENTS

| | | | |
|---|---|---|---|
| 1,304,616 | 5/1919 | Smith . | |
| 4,578,883 | 4/1986 | Dassler | 36/59 C |
| 4,716,664 | 1/1988 | Taylor | 36/114 |
| 4,866,861 | 9/1989 | Noone | 36/127 |
| 4,875,683 | 10/1989 | Wellman et al. | 36/127 |
| 5,243,776 | 9/1993 | Zelinko | 36/127 |

*Primary Examiner*—M. D. Patterson

[57] ABSTRACT

A pair of shoes for use by golfers includes a first shoe to be worn on a golfer's rear foot as the golfer addresses a golf ball which is provided with a sole and a heel and a plurality of spikes which extend downwardly from the sole and the heel. A second shoe is provided to be worn on a golfer's front foot as the golfer addresses a golf ball, and the second shoe is provided with a smooth, spikeless sole and a smooth, spikeless heel for enabling the golfer to make a proper turn to face the target during the golf swing.

7 Claims, 1 Drawing Sheet

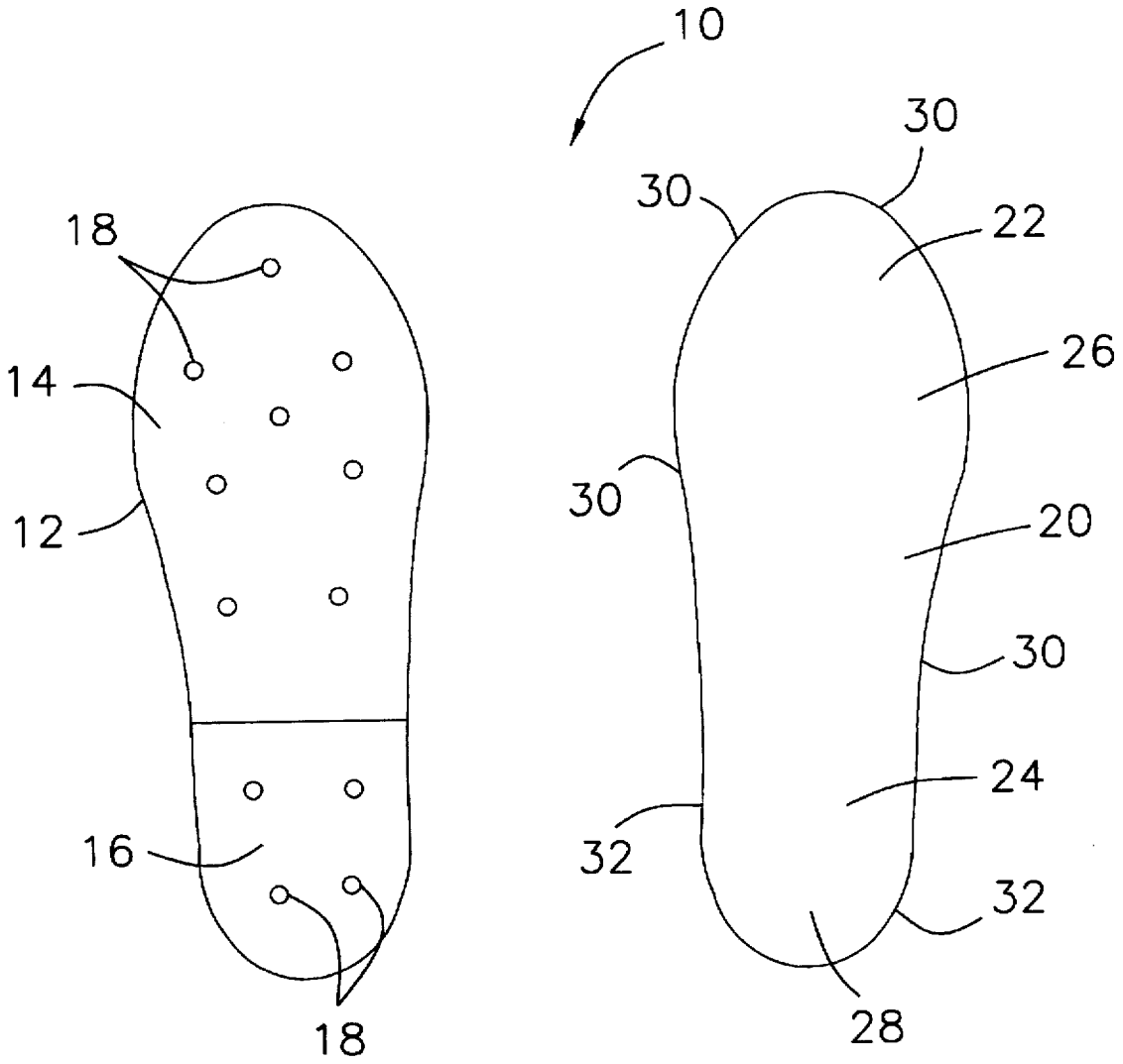
10
18
14
12
16
18
30
30
22
26
30
20
30
24
32
32
28

PAIR OF SHOES FOR USE BY GOLFERS AND A METHOD OF SWINGING A GOLF CLUB USING THE SAME

CONTINUING APPLICATION DATA

This application is a continuation of application Ser. No. 08/561,707 filed Nov. 22, 1995 now abandoned, the disclosure of which is incorporated herein:

BACKGROUND OF THE INVENTION

This invention relates to the sport of golfing and more particularly to a pair of shoes for use by golfers.

In executing a golf swing correctly, it is important that the golfer end up facing the target. Unfortunately, most golfers cannot successfully make this movement when they are wearing a standard pair of spiked golf shoes because the spikes of the shoes root their feet to the ground. Restraining movement of the golfer's front foot makes it difficult for the average golfer to make the proper turn during the golf swing so that his body is properly facing toward the target at the end of the swing.

As a result of not being able to make the proper turn through the ball with the body facing toward the target at the end of the golf swing, the hips and shoulders of the golfer "pile up" and the golfer is not able to deliver the power of the big muscles of the back and shoulders in the desired manner. In addition, when the hips and shoulders "pile up," tremendous strain is placed on the ankles, knees, front hip and back of the golfer. This results in thousands of injuries of varying degree each year.

During the golf swing there is also a translational component of motion during the downswing, and conventionally spiked golf shoes which are firmly rooted to the ground do not permit this translational component of motion. As a result, the average golfer is forced to make an unbalanced follow-through with improper weight transfer to the forward foot.

Various modifications to conventional spiked golf shoes have been designed in an attempt to enable a golfer to make the proper movements during the golf swing without injury. For example, U.S. Pat. Nos. 1,304,616 and 5,243,776 describe golf shoe constructions which are provided with pivoted spike-supporting plates. As described in these patents, the golfer wears the shoes on each foot so that both feet are permitted to rotate during the golf swing.

Unfortunately, if both feet of the golfer are permitted to rotate during the golf swing, a proper swing does not result. This is because it is important for the golfer's rearward foot to remain firmly positioned during the backswing so that resistance and forces are built-up by the coiling action of the golfer's torso and arms around the rear leg. This storing of energy on the backswing is not possible by use of the shoes described in U.S. Pat. Nos. 1,304,616 and 5,243,776 because the entire body and legs of the golfer rotate. As a result, the necessary tension and coiling potential would not be created between the golfer's torso and arms and his rearward leg during the backswing.

It is, therefore, an object of the present invention to provide a pair of shoes for use by golfers which readily enables the golfer to complete the follow-through during the golf swing so that the golfer's body is properly facing toward the target at the end of the golf swing.

Another object is to provide a pair of shoes for use by golfers which permits the rearward foot of the golfer to remain firmly rooted and fixed in position with respect to the ground during the backswing but which permits the forward foot of the golfer to slideably rotate with respect to the ground during the follow-through of the golf swing.

A further object of the invention is the provision of a pair of shoes for use by golfers which enables the golfer's forward foot to have a translational component of motion during the golf swing.

Still another object is to provide a pair of shoes for use by golfers which are easy to use and maintain and which are inexpensive to manufacture.

A still further object is to provide a pair of shoes for use by golfers which will reduce injuries.

Yet another object of the present invention is the provision of a pair of shoes for use by golfers which enables a golfer to deliver the power of the big muscles of the back and shoulders in the most effective manner during the golf swing.

Another object is to provide a pair of shoes for use by golfers which avoids strain on the golfer's ankles, knees, front hip and back during the golf swing.

Still another object is to provide a pair of shoes for use by golfers which allows the golfer's body parts to turn freely during the golf swing.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects the present invention provides a pair of shoes for use by golfers, the pair of shoes comprising: a first shoe to be worn on a golfer's rear foot as the golfer addresses a golf ball, the first shoe having a first sole and a first heel and a plurality of spikes extending downwardly from the first sole and from the first heel; and a second shoe to be worn on a golfer's front foot as the golfer addresses a golf ball, the second shoe having a second smooth slippery spikeless sole and a second smooth slippery spikeless heel.

It is to be understood that both the foregoing general description and the following detailed description are exemplary and explanatory but are not restrictive of the invention.

BRIEF DESCRIPTION OF THE DRAWINGS

The accompanying drawing, which is incorporated in and constitutes a part of this specification, illustrates a preferred embodiment of the invention and, together with the description, serves to explain the principles of the invention.

The FIGURE is a bottom plan view of the pair of shoes for use by golfers constructed in accordance with the invention.

DESCRIPTION OF THE PREFERRED EMBODIMENT

With reference now to the drawing, there is shown a pair of shoes 10 for use by golfers. The pair of shoes illustrated are for use by right-handed golfers wherein first shoe 12 is to be worn on the golfer's rear foot as the golfer addresses a golf ball. In accordance with the invention, first shoe 12 includes a first sole 14 and a first heel 16, and a plurality of spikes 18 are connected to and extend downwardly from sole 14 and from heel 16. First shoe 12 is a conventional golf shoe.

Shoe pair 10 also includes a second shoe 20 to be worn on a golfer's front foot as the golfer addresses a golf ball. In accordance with the invention, second shoe 20 includes a second smooth slippery spikeless sole 22 and a second smooth slippery spikeless heel 24.

Sole 22 and heel 24 define bottom surfaces 26, 28, respectively, and each of surfaces 26, 28 has a coefficient of static friction on dry grass of approximately 0.05 to 0.30. Surfaces 26, 28 are preferably connected together to form a single continuous smooth flat bottom surface. This enables shoe 20 to rotate freely through and over grass without the resistance which would be created by a separate raised heel surface.

In accordance with the invention, sole 22 of shoe 20 defines a rounded outer edge 30, and heel 24 of shoe 20 also defines a rounded outer edge 32. Rounded edges 30, 32 enhance the ability of shoe 20 to slide through and over grass and over uneven ground surfaces. Sole 22 and heel 24 are preferably comprised of a plastic material, such as polyethelene.

In use, shoe 12 is worn on the right foot of a right-handed golfer, and shoe 20 is worn on the left foot of a right-handed golfer. Thus, when the right-handed golfer addresses the golf ball, shoe 12 is on the golfer's rear foot and shoe 20 is on the golfer's front foot.

When the golfer starts his golf swing and executes the backswing, spikes 18 of shoe 12 firmly hold the golfer's rear foot in position on the ground. As a result, resistance and forces are created by the coiling action of the golfer's torso as the torso and golfer's arms rotate about the axis formed by the golfer's rear leg. This storing of energy on the backswing is important for providing the power necessary for a strong golf shot as the golf club swings downwardly and into contact with the golf ball.

Once the right-handed golfer's hips have started to turn to the left during the downswing, it is important that the golfer's hips and torso continue to move in that direction until the golfer faces the target at the completion of the golf swing. For many golfers, however, it is difficult to properly complete the golf swing in this manner because the golfer's front spiked shoe is firmly rooted to the ground and cannot rotate and slike. When spikes are used on the golfer's forward shoe, the golfer is often not able to make the proper turn through the ball and the golfer's hips and shoulders "pile up" so that the golfer is not able to deliver the power of the big muscles of the back and shoulders during the golf swing.

By use of shoe 20 on the golfer's forward foot, however, even the average or poor golfer is able to make the correct turn during the golf swing. This is because shoe 20 can slideably rotate over the grass surface during the golf swing to enable the golfer's front foot to rotate. As a result, the hips and shoulders of the golfer do not "pile up" and strain is avoided on the ankles, knees, front hip and back of the golfer. In addition, because the golfer's hips have translational components of motion during the downswing as well as rotational components of motion, use of shoe 20 on the forward foot of the golfer will permit this translational component of motion to occur without strain on the golfer because shoe 20 can slide over the grass surface.

Rounded edges 30, 32 of shoe 20 and the continuous smooth flat bottom surface of shoe 20 make it easier for shoe 20 to slide and rotate through and over grass and over uneven ground. Rounded edges 30, 32 also reduce the possibility that the edges will catch or hang-up on irregularities in the grass or on the ground as the golfer makes his swing.

Although shoe pair 10 is illustrated and has been described for use by right-handed golfers, it should be understood that this invention is also applicable for use by left-handed golfers. In that circumstance, the spiked shoe would be worn on the left foot of the golfer and the smooth soled and smooth heeled shoe would be worn on the right foot of the golfer.

This invention provides for a simple and effective shoe configuration for use by golfers which will enable golfers to make a proper golf swing without injury.

The invention in its broader aspects is not limited to the specific details shown and described, and departures may be made from such details without departing from the principles of the invention and without sacrificing its chief advantages.

What is claimed is:

1. A method of swinging a golf club comprising the steps of:

wearing a first shoe on a rear foot as a golfer addresses a golf ball, the first shoe having a first sole and a first heel and a plurality of spikes extending downwardly from at least one of the first sole and the first heel, and a second shoe on a front foot as the golfer addresses a golf ball, the second shoe having a second sole and a second heel, the second sole and the second heel being smooth and spikeless;

executing a backswing as the first shoe holds the rear foot in position by engagement between the spikes and ground;

executing a downswing having translational and rotational components; and rotating and sliding the front foot as the second shoe slides and rotates along the ground.

2. A method as recited in claim 1, wherein in said wearing step, the second sole and the second heel define bottom surfaces having a coefficient of static friction on dry grass of 0.05 to 0.30 inclusive.

3. A method as recited in claim 1, wherein in said wearing step, the second sole and the second heel define rounded outer edges.

4. A method as recited in claim 3, wherein in said wearing step, the second sole and the second heel define bottom surfaces having a coefficient of static friction on dry grass of 0.05 to 0.30 inclusive.

5. A method as recited in claim 3, wherein in said wearing step the second sole and the second heel are formed of a plastic material.

6. A method as recited in claim 4, wherein in said wearing step, the second sole and the second heel are formed in a continuous manner to define a single continuous smooth substantially flat bottom surface on the second shoe.

7. A method as recited in claim 1 wherein, in said wearing step, the second sole and the second heel are formed in a continuous manner to define a single continuous smooth substantially flat bottom surface on said second shoe.

* * * * *